US012245693B2

(12) United States Patent
Urak

(10) Patent No.: US 12,245,693 B2
(45) Date of Patent: Mar. 11, 2025

(54) FASTENING ELEMENT FOR GUIDE RAIL

(71) Applicant: SAMET KALIP VE MADENI ESYA SAN VE TIC. A.S, Istanbul (TR)

(72) Inventor: Evren Urak, Istanbul (TR)

(73) Assignee: SAMET KALIP VE MADENI ESYA SAN VE TIC. A.S, Istanbul (TR)

( * ) Notice: Subject to any disclaimer, the term of this patent is extended or adjusted under 35 U.S.C. 154(b) by 91 days.

(21) Appl. No.: 17/768,526

(22) PCT Filed: Oct. 24, 2019

(86) PCT No.: PCT/TR2019/050892

§ 371 (c)(1),
(2) Date: Apr. 13, 2022

(87) PCT Pub. No.: WO2021/080526

PCT Pub. Date: Apr. 29, 2021

(65) Prior Publication Data

US 2024/0108134 A1 Apr. 4, 2024

(51) Int. Cl.
*A47B 88/40* (2017.01)
*A47B 88/43* (2017.01)
(Continued)

(52) U.S. Cl.
CPC ..... *A47B 88/43* (2017.01); *F24C 15/168* (2013.01); *A47B 88/423* (2017.01); *A47L 15/507* (2013.01); *F24C 15/16* (2013.01)

(58) Field of Classification Search
CPC ... A47B 88/43; A47B 88/423; A47B 88/4278; F24C 15/168; F24C 15/16; A47L 15/507;
(Continued)

(56) References Cited

U.S. PATENT DOCUMENTS

2001/0044992 A1 11/2001 Jahrling
2009/0016812 A1 1/2009 Wittgrebe
(Continued)

FOREIGN PATENT DOCUMENTS

EP 2532273 A1 12/2012
EP 2470835 B1 10/2015
(Continued)

OTHER PUBLICATIONS

English machine translation of EP 2532273 A1, retrieved from PE2E-Search database, provided by Clarivate Analytics, on Sep. 19, 2024. (8 pages) (Year: 2024).*

*Primary Examiner* — Jack W Lavinder
(74) *Attorney, Agent, or Firm* — Bayramoglu Law Offices LLC

(57) ABSTRACT

The fastening element provides easy detachably connection between a guide rail and a side panel and can be used in a baking oven, dishwasher, refrigerator, or similar appliances. The fastening element includes a first retaining element lying below a horizontal bar of a side panel, especially for ovens, which prevents the fastening element being withdrawn in a direction parallel to the vertical bar, and a second retaining element attached to the guide rail which engages behind an angled end region of the horizontal bar and prevents fastening element being withdrawn in a direction parallel to the horizontal bar. The fastening element further includes a resilient lug which at least partially encloses a section of the horizontal bar. The fastening element is disengaged from the horizontal bar such that the resilient lug is manually bent down.

9 Claims, 3 Drawing Sheets

(51) Int. Cl.
*A47L 15/50* (2006.01)
*F24C 15/16* (2006.01)
*A47B 88/423* (2017.01)

(58) Field of Classification Search
CPC ..... Y10T 24/44017; Y10T 24/4406; Y10T 403/349
See application file for complete search history.

(56) References Cited

U.S. PATENT DOCUMENTS

| | | | | |
|---|---|---|---|---|
| 2009/0127217 | A1 | 5/2009 | Wittgrebe | |
| 2011/0123260 | A1* | 5/2011 | Budde | F16B 7/0433 403/188 |
| 2012/0145856 | A1 | 6/2012 | Reidt et al. | |
| 2017/0303685 | A1 | 10/2017 | Rehage et al. | |

FOREIGN PATENT DOCUMENTS

| | | | |
|---|---|---|---|
| EP | 3401607 | A1 | 11/2018 |
| WO | 2010089553 | A1 | 8/2010 |

* cited by examiner

FASTENING ELEMENT FOR GUIDE RAIL

CROSS REFERENCE TO THE RELATED APPLICATIONS

This application is the national phase entry of International Application No. PCT/TR2019/050892, filed on Oct. 24, 2019, the entire contents of which are incorporated herein by reference.

TECHNICAL FIELD

The present invention relates to a fastening element for fastening a guide rail to a side panel of a household appliances, such as baking oven, dishwasher, refrigerator and so on. The present invention particularly relates to a fastening element which ensures practical fastening and unfastening between a guide rail and side panel and provide a very simple form.

BACKGROUND

EP 3 401 607 A1 discloses a locking element which connects a slide rail to a supporting bar, comprising an upper locking plate which is to be connected to the slide rail, a lower locking plate and a connection plate which connects the upper locking plate and the lower locking plate. The upper locking plate and the lower locking plate provide a receptacle for receiving the supporting part of the supporting bar while the connection plate surrounds the fixing part of the supporting bar. The lower locking plate and the upper locking plate face to each other in order to provide a strong connection between the locking element and the supporting bar. Such locking elements lead to jamming of the supporting bar between the upper and the lower locking plates, thereby causing detachment problems between the slide rail and the supporting bar, especially in long term used.

Another example of such locking elements is also described in EP 2 470 835 B1 comprising a holding section having a lower leg and an upper leg for enclosing a part of a rod and another holding section for receiving an angled part of the rod. The locking element also comprises a locking lug provided on a lower leg which engages with a beading formed in the upper leg in order to provide a secure connection. Again such locking elements are complicated to ensure locking and unlocking between the slide rail and the rod of a side panel and in some cases even a tool is required for unlocking.

The present invention provides a fastening element which ensures easy attachment and detachment between a guide rail and a side panel. In case a user wants to remove the guide rail from the side panel, there is no need him to use a tool in order to unfasten the fastening element from a bar of the slide panel. Similarly, there is no need for a tool to fasten the guide rail onto the bar of the slide panel thanks to the fastening element of the invention. Additionally, the fastening element according to the invention ensures cost efficient design while providing a strong and secure connection between the guide rail and the side panel.

SUMMARY

The present invention relates to a fastening element which provides detachably easy connection between a guide rail and a side panel which can be used in a baking oven, dishwasher, refrigerator or similar appliances.

The fastening element ensures a connection between a guide rail and a horizontal bar of a side panel. The side panel comprises a plurality of horizontal bars, each of which has angled end regions at its ends. The horizontal bars are attached between at least two vertical bars via the angled end regions.

The fastening element of the invention comprises a first retaining element lying below the horizontal bar which prevents the fastening element being withdrawn in a direction parallel to the vertical bar, and a second retaining element attached to the guide rail which engages behind the angled end region of the horizontal bar and prevents fastening element being withdrawn in a direction parallel to the horizontal bar. The fastening element further comprises a resilient lug which at least partially encloses a section of the horizontal bar. The fastening element is disengaged from the horizontal bar such that the resilient lug is manually bended down.

The resilient lug comprises a locking portion which supports behind the horizontal bar and a holding portion which encloses a section of the horizontal bar. The locking portion may be formed as an upward inclination. However, it is conceivable that the locking portion may also be formed as a protrusion leaning behind the horizontal bar. The holding portion may be formed by being bulged down of the resilient lug.

The resilient lug may comprise an actuating portion extended out from the holding portion in order to ease of bending down of the resilient lug. However, the actuating portion can also be formed as a protrusion or a handle formed on the outside surface of the holding portion.

The fastening element may comprise a support section disposed on the first retaining element at its one end. The support section at least partially encloses a section of the horizontal bar.

The first retaining element may comprise a supporting web proceeding down from a base of the first retaining element in order to increase the resistance of the resilient lug when it is bended down for the disengagement from the horizontal bar.

The second retaining element comprises a web proceeding upward from the base of the first retaining element and engaging behind the angled end region and a support tab bent out from the web and attached to the guide rail. The support tab is directed away from the base of the first retaining element.

REFERENCE NUMBERS

Figure 1:
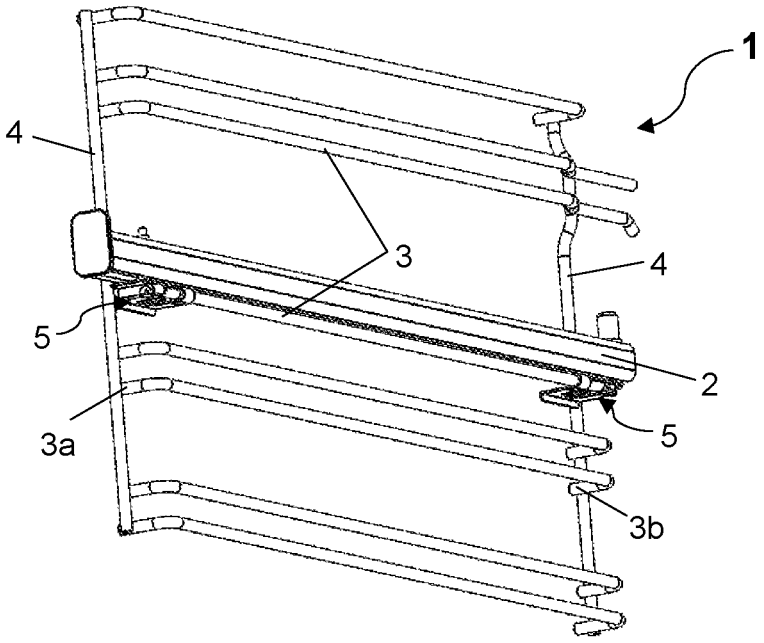
FIG. 1 is a perspective view of a side panel (1) onto which a guide rail (2) is attached by means of two fastening elements (5).

1 Side panel
2 Guide rail
3 Horizontal bar
3*a*, 3*b* Angled end region
4 Vertical bar
5 Fastening element
50 First Retaining Element
50.1 Base
51 Second Retaining Element
51.1 Web
51.2 Support Tab
52 Resilient Lug
52.1 Locking portion
52.2 Holding portion
52.3 Actuating portion
53 Support Section
54 Supporting Web

DETAILED DESCRIPTION OF THE EMBODIMENTS

FIG. 1 is a view showing use of a fastening element (5) according to the invention, wherein a guide rail (2) is attached to a side panel (1) by means of the two fastening elements (5). The FIG. 1 shows a perspective view of the side panel (1) which may be attached to an inner wall of a baking oven, dishwasher, refrigerator or similar appliances.

The side panel (1) comprises a plurality of horizontal bars (3), each of which has angled end regions (3*a*,3*b*) at its front and rear. Each horizontal bar (3) is connected between two vertical bars (4) via the angled end regions (3*a*,3*b*). The horizontal bars (3) are connected between the vertical bars (4) so as to be spaced apart each other.

Figure 2:
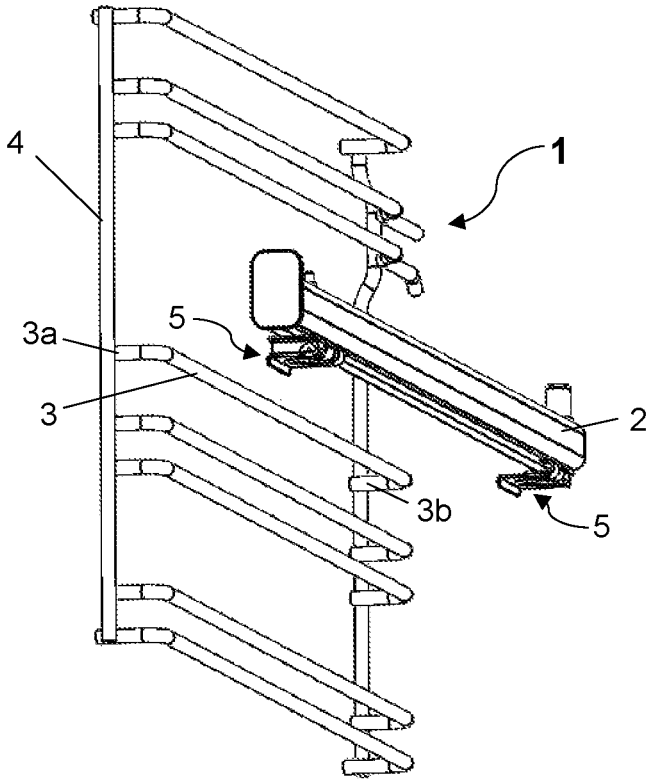
FIG. 2 is a perspective view of the side panel (1) of FIG. 1 from which the guide rail (2) is taken out.

The guide rail (2) is fastened to one of the horizontal bar (3) by means of two fastening elements (5), one of which is connected to underside of the guide rail (2) at its front region, the other one is connected to underside of the guide rail (2) at its rear region. FIG. 2 shows a perspective view of the side panel (1) of the FIG. 1 wherein the guide rail (2) is unfastened from the horizontal bar (3).

Figure 3:
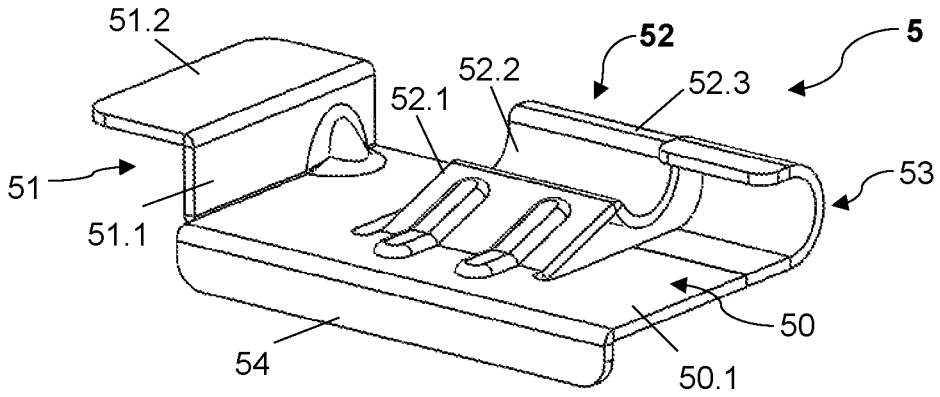
FIG. 3 is a perspective view of the fastening element (5) removed from the guide rail (2).

In FIG. 3, a perspective view of the fastening element (5) according to the invention is shown as removed from the guide rail (2). The fastening element (5) comprises a first retaining element (50) by means of which the fastening element (5) is fastened to the horizontal bar (3) of the side panel (1) and a second retaining element (51) by means of which the fastening element (5) is attached to underside of the guide rail (2). The first retaining element (50) supports the bottom of the horizontal bar (3) and prevents the movement of the guide rail (2) from the side panel (1) in the direction of the vertical bar (4) while the second retaining element (51) supports the angled end region (3*a*,3*b*) of the horizontal bar (3) from outside thereby preventing movement of the guide rail (2) from the side panel (1) in the direction of the horizontal bar (3).

The second retaining element (51) comprises a web (51.1) which ensures connection with the first retaining element (50) and a support tab (51.2) which is bent out from the web (51.1). The support tab (51.2) is directly or indirectly attached to underside of the guide rail (2) and the web (51.1) bears against the angled end region (3*a*,3*b*) of the horizontal bar (3) from outside. The support tab (51.2) faces away from a base (50.1) of the first retaining element (50).

Figure 4:
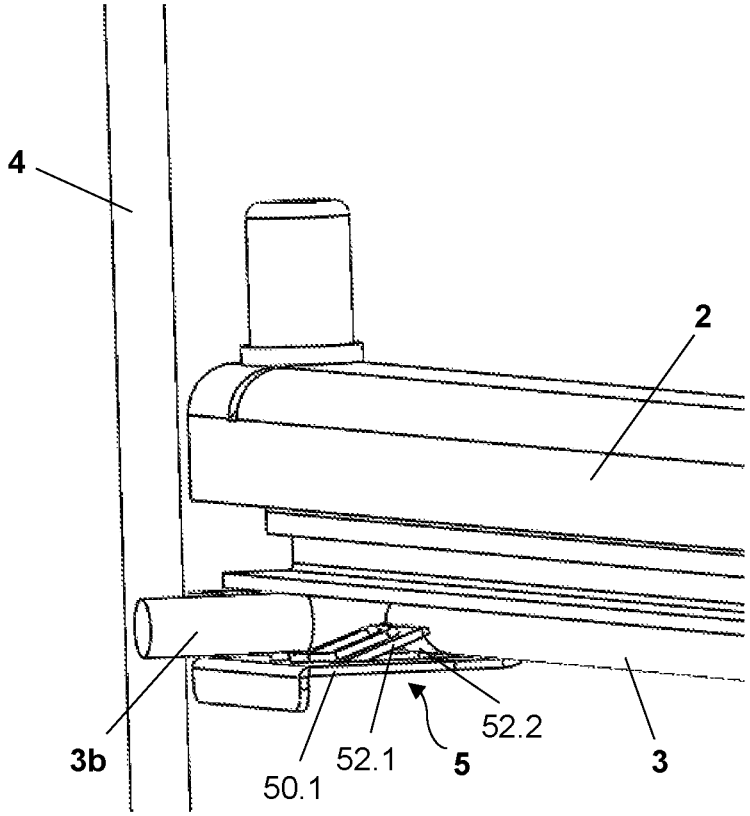
FIG. 4 is a partial perspective rear view of the side panel (1) wherein the guide rail (2) is attached to a horizontal bar (3) of the side panel (1), at its rear region, by means of the fastening element (5).

The fastening element (5) further comprises a resilient lug (52) which is free from the base (50.1) of the first retaining element (50) to ensure more flexibility. The resilient lug (52) comprises a locking portion (52.1) and a holding portion (52.2) which at least partially encloses a section of the horizontal bar (3). The locking portion (52.1) is inclined upward from the base (50.1) of the first retaining element (50) and the holding portion (52.2) providing a hollow shape is disposed at the edge of the locking portion (52.1). The locking portion (52.1) provides a support behind the horizontal bar (3) and prevents unintentional removal of the fastening element (5), namely the guide rail (2), from the horizontal bar (3), as seen in FIG. 4.

The resilient lug (52) comprises an actuating portion (52.3) disposed at the edge of the holding portion (52.2). In this exemplary embodiment shown in FIGS. 1-6, the actuating portion (52.3) is formed by bending out of the holding portion (52.2). However, it is of course conceivable that it can also be formed as a protrusion or a handle formed on the outside surface of the holding portion (52.2). The actuating portion (52.3) enables the resilient lug (52) to be handled by an operator in order to pull it down which results in that the locking portion (52.1) releases behind the horizontal bar (3).

The fastening element (5) may have a support section (53) holding the horizontal bar (3) from outside in order to increase securely positioning of the horizontal bar (3) onto the first retaining element (50). As seen in FIG. 3, the support section (53) advantageously provides C form and attached to the base (50.1) of the first retaining element (50) at its one end. The C form support section (53) encloses the horizontal bar (3) from outside as well as from the top. The support section (53) provides a rigid form.

Further the fastening element (5) may have a supporting web (54) disposed at the edge of the first retaining element (50) opposite to the support section (53) in order to increase resistance of the fastening element (5) while the resilient lug (52) is bended down to release the horizontal bar (3) from the fastening element (5).

The FIG. 4 provides a view showing the rear connection between the guide rail (2) and the side panel (1) by means of the fastening element (5). Herein the horizontal bar (3) is supported by the first retaining element (50) from the bottom and the locking portion (52.1) leans against behind the horizontal bar (3) in order to prevent unintentional withdrawal of the guide rail (2) in the direction of the angled end region (3*a*,3*b*).

In order to provide connection between the fastening element (5) attached to bottom end region of the guide rail (2) and the horizontal bar (3) of a side panel (1), the horizontal bar (3) is seated onto the base (50.1) of the first retaining element (50) and the guide rail (2) is pushed further until the horizontal bar (3) is enclosed by the holding portion (52.2) of the retaining lug (52). In this mounted state, seen in FIG. 4, the holding portion (52.2) at least partially encloses a section of the horizontal bar (3) and the locking portion (52.1) bears against behind the horizontal bar (3). The web (51.1) of the second retaining element (51) supports the angled end region (3*a*,3*b*) of the horizontal bar (3) from outside in order to prevent movement of the guide rail (2) in the direction of the horizontal bar (3). The same applies to the other fastening element (5) which is attached to opposite bottom end region of the guide rail (2). Therefore, the movement of the guide rail (2) along with the horizontal bar (3) is prevented by the webs (51.1) of the fastening elements (5) which are opposingly connected to bottom of the guide rail (2).

Figure 5:
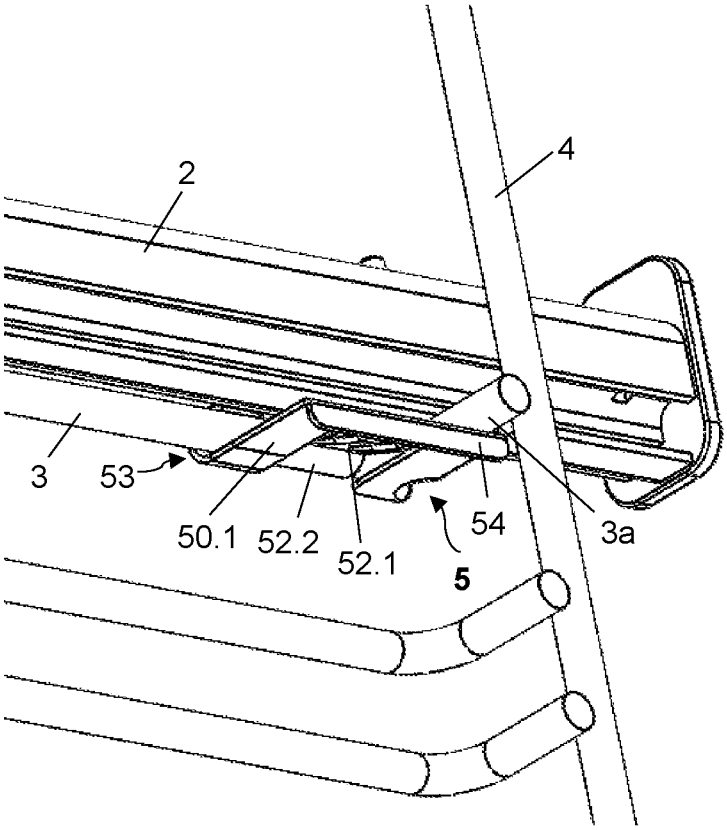
FIG. 5 is an underside perspective view of the fastening element (5) attaching the guide rail (2) onto the horizontal bar (3) of the side panel (1) from the front region.

FIG. 5 shows an underside view of the fastening element (5) attaching the front end region of the guide rail (2) to the horizontal rod (3) of the side panel (1). As it may be seen in FIG. 5, there is advantageously provided a clearance between the fastening element (5) and the vertical bar (4), in the mounted state, in order to avoid jamming between them.

Figure 6:
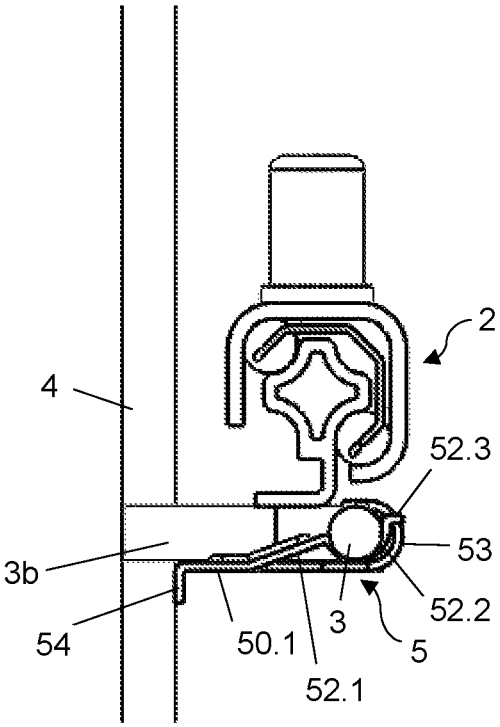
FIG. 6 is a sectional view of the side panel (1) of the FIG. 1 wherein the guide rail (2) is attached to the horizontal bar (3) by means of the fastening element (5) according to the invention.

The FIG. 6 shows the sectional view of the side panel (1) wherein the guide rail (2) is attached to the horizontal bar (3) by means of the fastening elements (5) according to the invention. As seen in FIG. 6, in the fastened state, the holding portion (52.2) of the resilient lug (52) partially encloses a section of the horizontal rod (3) and the locking portion (52.1) leans against behind the horizontal bar (3). The actuating portion (52.3) of the resilient lug (52) is extended out from the holding portion (52.2) in order to ease of holding the resilient lug (52) for bending down.

What is claimed is:

1. A fastening element, wherein the fastening element is configured for fastening a guide rail onto a horizontal bar of a side panel for ovens, wherein the horizontal bar comprises an angled end region, wherein the horizontal bar is attached to a vertical bar of the side panel through the angled end region, and the fastening element comprises a first retaining element, a second retaining element, and a resilient lug, wherein the first retaining element lies below the horizontal bar to prevent the fastening element from being withdrawn in a direction parallel to the vertical bar, and the second retaining element is attached to the guide rail and engages behind the angled end region of the horizontal bar to prevent the fastening element from being withdrawn in a direction parallel to the horizontal bar, wherein the resilient lug at least partially encloses a section of the horizontal bar, wherein when the fastening element is disengaged from the horizontal bar, the resilient lug is manually bent down to release the horizontal bar, wherein the resilient lug comprises a locking portion and a holding portion, wherein the locking portion is formed as an upward inclination supporting behind the horizontal bar, and the holding portion is formed by being bulged down of the resilient lug and enclosing the section of the horizontal bar.

2. The fastening element according to claim 1, wherein the resilient lug comprises an actuating portion extended out from the holding portion in order to ease of bending down of the resilient lug.

3. The fastening element according to claim 2, wherein the fastening element further comprises a support section disposed on the first retaining element and at least partially enclosing the section of the horizontal bar.

4. The fastening element according to claim 1, wherein the fastening element further comprises a support section disposed on the first retaining element and at least partially enclosing the section of the horizontal bar.

5. The fastening element according to claim 1, wherein the first retaining element comprises a supporting web proceeding down from a base of the first retaining element in order to increase a resistance of the resilient lug when the resilient lug is bent down for a disengagement from the horizontal bar.

6. A guide rail, comprising at least two of the fastening elements according to claim 1.

7. The fastening element according to claim 1, wherein the fastening element further comprises a support section disposed on the first retaining element and at least partially enclosing the section of the horizontal bar.

8. A fastening element, wherein the fastening element is configured for fastening a guide rail onto a horizontal bar of a side panel for ovens, wherein the horizontal bar comprises an angled end region, wherein the horizontal bar is attached to a vertical bar of the side panel through the angled end region, and the fastening element comprises a first retaining element, a second retaining element, and a resilient lug, wherein the first retaining element lies below the horizontal bar to prevent the fastening element from being withdrawn in a direction parallel to the vertical bar, and the second retaining element is attached to the guide rail and engages behind the angled end region of the horizontal bar to prevent the fastening element from being withdrawn in a direction parallel to the horizontal bar, wherein the resilient lug at least partially encloses a section of the horizontal bar, wherein when the fastening element is disengaged from the horizontal bar, the resilient lug is manually bent down to release the horizontal bar, wherein the second retaining element comprises a web and a support tab, wherein the web proceeds upward from a base of the first retaining element and engages behind the angled end region, and the support tab is bent out from the web and attached to the guide rail.

9. The fastening element according to claim 8, wherein the support tab faces away from the base of the first retaining element.

* * * * *